US005083614A

United States Patent [19]

Branch

[11] Patent Number: 5,083,614

[45] Date of Patent: Jan. 28, 1992

[54] FLEXIBLE GRAVEL PREPACK PRODUCTION SYSTEM FOR WELLS HAVING HIGH DOG-LEG SEVERITY

[75] Inventor: Rodney L. Branch, Houston, Tex.

[73] Assignee: Tex/Con Gas and Oil Company, Houston, Tex.

[21] Appl. No.: 591,560

[22] Filed: Oct. 2, 1990

[51] Int. Cl.[5] ..... E21B 43/04

[52] U.S. Cl. ..... 166/278; 166/51; 166/235

[58] Field of Search ..... 166/278, 50, 51, 227, 166/228, 230, 234, 235

[56] References Cited

U.S. PATENT DOCUMENTS

| | | | |
|---|---|---|---|
| 1,594,788 | 8/1926 | McLaughlin et al. | 166/236 |
| 2,335,558 | 11/1943 | Young | 166/235 |
| 2,681,111 | 6/1954 | Thompson | 166/235 |
| 2,696,264 | 12/1954 | Colmerauer et al. | 166/235 |
| 2,804,926 | 9/1957 | Zublin | 166/235 |
| 2,872,984 | 2/1959 | Fether | 166/235 |
| 2,942,668 | 6/1960 | Maly et al. | 166/227 |
| 3,106,526 | 10/1963 | Schmidt | 166/235 |

*Primary Examiner*—Terry L. Melius

*Attorney, Agent, or Firm*—Renner, Otto, Boisselle & Sklar

[57] ABSTRACT

A gravel prepack production system characterized by a flexible gravel prepack comprising an inner tube and a plurality of discrete annular filter elements carried on the inner tube and longitudinally spaced therealong by spacers. The tube is free to flex at the segments thereof intermediate the relatively rigid filter elements to enable the gravel prepack to traverse even severe doglegs in the well. The filter elements and spacers may be strung onto the inner tube at the production site to configure the gravel prepack to the particular application as by selecting a desired spacing between the filter elements.

19 Claims, 2 Drawing Sheets

FLEXIBLE GRAVEL PREPACK PRODUCTION SYSTEM FOR WELLS HAVING HIGH DOG-LEG SEVERITY

The invention herein described relates generally to oil and gas production equipment and methods and, more particularly, to a gravel prepack production system and related apparatus and methodology which may be applied to short and ultra-short radius wells as well as medium and long radius wells.

BACKGROUND OF THE INVENTION

Horizontal wells are being widely used throughout the oil and gas industry to enhance project economics and to develop reservoirs that would otherwise not be commercially viable. Well productivity can be increased with horizontal wells and many fields have been developed for this reason. Horizontal wells have been completed in high productivity reservoirs for the purpose of reducing gas and/or water coning, thereby improving drainage efficiency and ultimate recovery.

Horizontal wells have been drilled and completed in poorly consolidated formations that typically have high permeability and high production potential. These formations, however, are often incapable of producing without some type of control technique for sand and other fine solids. Sand and fine solids produced with oil and gas are major causes of uneconomic production, resulting in excessive expense as well as wear and down time on pumps, tubing, traps and other equipment. The industry has recognized the use of gravel packed completions as a solution to sand control problems.

In normal vertical wells, the cost of gravel packing is usually less than ten percent of the total well cost. Because the benefits of a successful gravel pack include unrestricted productivity, long term performance and selective production capability, the decision to gravel pack is normally made without much difficulty. However, faced with production intervals from 10–30 times the typical completion length in a vertical well, operators must give extra consideration in horizontal wells where the completion cost could equal or exceed the drilling cost.

A conventional gravel packing technique involves locating a perforated liner at a subsurface location in the well and thereafter placing gravel around the perforated liner. A slurry of gravel suspended in a liquid carrier is pumped into the annular space between the formation wall and the liner. As the suspension reaches the bottom of the annulus the gravel is compactly deposited in the annulus on the exterior of the liner and the liquid carrier withdraws through the liner perforations and back up the casing string. In this manner the gravel progressively builds up in the annulus surrounding the liner.

A problem encountered with this technique arises when the well bore deviates from the vertical. When the well is inclined, the gravel oftentimes fails to pack uniformly, resulting in voids within the packed annulus which weaken the pack and permit the production of sand entrained fluids.

Various alternatives to such open hole gravel packs include the use of prepacked liners, i.e., gravel prepacks. A conventional gravel prepack has a layer of uniformly sized gravel contained between concentric screens such that fluid flow must pass through the gravel to enter the well bore. The gravel prepack may contain either loose or consolidated gravel, the latter offering more protection from erosion because the sand grains cannot settle, reorient or move which could allow formation sand to penetrate into the well bore. The screens may be, for example, perforated tubes or wire wrapped screens.

A problem with conventional gravel prepacks is their inability to pass through a severe dog-leg in the well. Many conventional gravel prepacks are too rigid to withstand deviations over 10–12 degrees per 100 feet.

SUMMARY OF THE INVENTION

The present invention provides for extension of the benefits afforded by gravel prepacks to wells in which high dog-leg severity previously inhibited or precluded use of conventional gravel prepacks. As a result of the present invention, wells may be drilled with shorter radii while maintaining a gravel prepack option.

In accordance with the invention, a gravel prepack to be installed in a hole formed in a fluid bearing formation to prevent sanding during production comprises an inner tube and a plurality of discrete annular filter elements carried on the inner tube and being relatively movable during flexing of the inner tube. The inner tube has openings therein for flow of fluid from the filter elements into the interior of the inner tube.

More particularly, each annular filter element includes axially spaced apart end caps at opposite axial ends of an interior chamber containing filter media, and radially outer and inner concentric screens extending between the end caps and surrounding the filter media in the interior chamber. Spacers are interposed between the annular filter elements to space them apart longitudinally along the inner tube. Preferably, the annular filter elements and spacers are strung onto the inner tube, and stop collars are mounted to the inner tube at opposite axial ends of the string for securing the string of annular filter elements and spacers against axial movement along the inner tube. The inner tube may be perforated in the regions between the spaced apart filter elements, and the spacers surround the intermediate regions to close the openings in such regions.

According to another aspect of the invention, gravel prepack equipment for assembly into a gravel prepack to be installed in a hole formed in a fluid bearing formation to prevent sanding during production, comprises a perforated inner tube, a plurality of annular filter elements adapted to be slid onto the inner tube, and a plurality of spacers adapted to be slid onto the inner tube for spacing the filter elements longitudinally along the inner tube.

According to a further aspect of the invention, a method of assembling a gravel prepack to be installed in a hole formed in a fluid bearing formation to prevent sanding during production, comprises the steps of stringing a plurality of annular filter elements onto an inner tube alternately with spacers operative to space the filter elements longitudinally along the inner tube, and then securing the string of filter elements and spacers against longitudinal movement along the inner tube. The securing step preferably includes securing stops to the inner tube at opposite ends of the string of filter elements and spacers, and preferably at least one of the stops is secured to the inner tube by screwing the stop onto a threaded portion of the inner tube.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
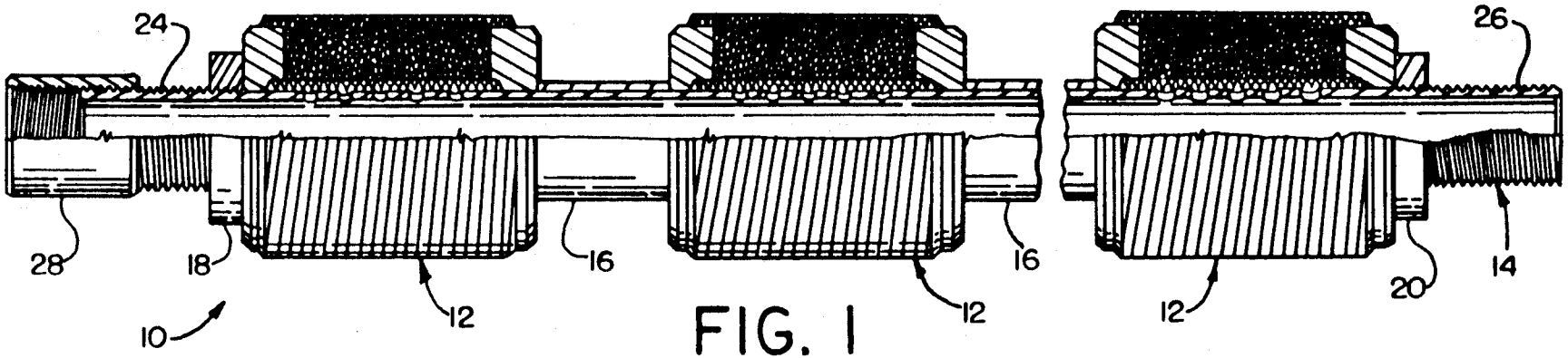
FIG. 1 is a side elevational view, partly broken away in cross-section, of a gravel prepack according to the invention.

Referring now in detail to the drawings and initially to FIG. 1, a gravel prepack according to the invention is indicated generally at 10. The gravel prepack 10 comprises a plurality of gravel pack elements 12 carried on an inner tube 14. As is preferred, the gravel pack elements 12 (also herein referred to as donuts) are strung onto the inner tube and are maintained axially spaced apart along the length of the inner tube by spacers 16. The alternating gravel pack elements and spacers are held together in end-to-end butted relationship by and between stop collars 18 and 20. Although any suitable means may be employed to mount the stop collars to the inner tube, preferably the stop collars are internally threaded for screwing onto externally threaded end portions 24 and 26 of the inner tube. The externally threaded end portions 24 and 26 also provide for connection of the inner tube 14 to other components of a production string. At the left in FIG. 1, there is shown a conventional internally threaded coupling 28 which may be used to connect the adjacent end of the inner tube to the end of an adjacent liner section in a production string.

Figure 3:
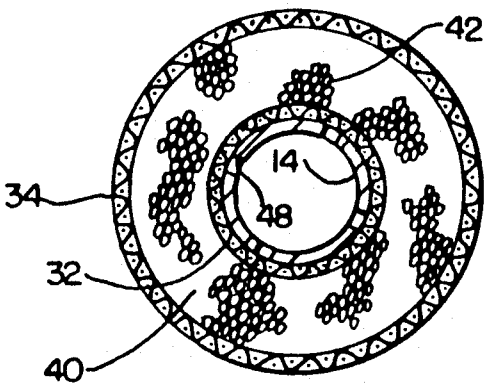
FIG. 3 is a transverse cross-sectional view through the gravel pack element of FIG. 2 taken substantially along the line 3—3 of FIG. 2.
Figure 2:
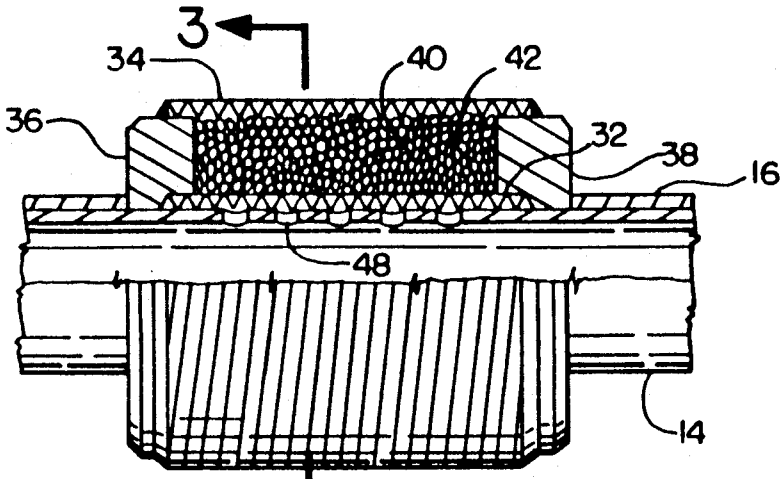
FIG. 2 is an enlarged side elevational view of one of the gravel pack elements employed in the assembly of FIG. 1.

With additional reference to FIGS. 2 and 3, each gravel pack element 12 includes inner and outer screens 32 and 34 which extend between end caps 36 and 38. The inner and outer screens 32 and 34 are radially spaced apart and the end caps 36 and 38 are axially spaced apart to form a containment chamber 40 for filtering media and, more particularly, gravel 42. For purposes of this description, the term "gravel" is intended to encompass any granular or aggregate material used for filtering purposes in subterranean wells to control the amount of sand produced with the fluid being recovered from the subterranean formation, be it oil, gas, water or other fluid. As used herein, the term "sand" is intended to encompass sand and other fine solids that may be produced with oil, gas or water in a subterranean well.

The inner and outer screens 32 and 34 preferably are concentric to give the annular chamber 40 a cylindrical shape of uniform radial thickness. The inner and outer screens may be of any suitable type such as, for example, a perforated tube or a wire wrapped screen. Continuous slot, welded wire screens may be obtained from Johnson Screens of Scott, La. As shown, the ends of the screens are welded to the end caps 36 and 38 to form a unitary structure, although other suitable means such as support rods may be employed to hold together as a unit the components of the gravel pack element 12.

In the illustrated embodiment, the end caps 36 and 38 are in the form of annular flange plates or rings having an inner diameter sized to fit over the outer diameter of the inner tube 14. Preferably the rings 36 and 38 are sized to provide a close fit on the inner tube to preclude any significant passage of production fluids between the end caps and the inner tube. The inner screen 32 also has an inner diameter sized to fit over the inner tube. If desired, the inner screen may be spaced radially outwardly from the outer surface of the inner tube to form spaces for collection of filtered production fluid as may be desired to promote flow. The gravel retained between the screens may be loose or consolidated. In the latter case, at least one of the screens 32 and 34 and particularly the inner screen may be omitted, although usually both screens will be desired to maintain the integrity of the gravel pack element.

The above described gravel pack element 12 is generally of conventional construction apart from its assembly on the inner tube 14. In contrast to conventional gravel prepacks, plural gravel pack elements 12 are carried on the inner tube 14 and each gravel pack element is less than and preferably much less than one-half the length of the inner tube. The length of the gravel pack element preferably is less than four times the inner diameter of the inner tube and more preferably is less than about three times the inner diameter of the inner tube. Also, the inner tube preferably has a diameter less than the liner tube of common conventional gravel prepacks while the outer diameter of the gravel pack elements may be the same as that employed in common conventional gravel prepacks. The smaller diameter inner tube 14 provides for increased flexibility to facilitate flexing and traversing of severe dog-legs in a well. Preferably, the ratio of outer diameter of the gravel pack element to the inner diameter of the inner tube is greater than 2.75:1 and more preferably equal to or greater than about 3:1 for a four inch outer diameter gravel pack element. For a six inch outer diameter gravel pack element, a preferred and more preferable ratio of outer diameter of the gravel pack element to the inner diameter of the inner tube are 2.25:1 and 2.5:1, respectively. For other diameters the preferred and more preferred ratios may be extrapolated from the foregoing ratios given for four inch and six inch outer diameter gravel pack elements.

The gravel pack elements 12 are mounted on the inner tube 14 for relative movement during flexing of the inner tube. In the illustrated embodiment, this is obtained by spacing the gravel pack elements axially apart along the length of the inner tube. As a result, the gravel pack elements can freely shift angularly with respect to one another during flexing of the inner tube, i.e., without interfering contact between adjacent gravel pack elements. Moreover, the segments of the inner tube between the gravel pack elements are more free to flex or bend than the portions of the inner tube that are surrounded by the gravel pack elements which are relatively rigid or stiff. These intermediate segments of the reduced diameter inner tube provide for increased flexibility of the overall assembly thereby to enable traversal of even ultra-short radius wells. As used herein, an "ultra-short radius" is 20 degrees/foot to 30 degrees/foot, a "short radius" is 1 degree/foot to 3 degrees/foot, a "medium radius" is 9 degrees/100 feet to 45 degrees/100 feet and a "long radius" is 1 degree/100 feet to 8 degrees/100 feet. The intermediate segments of the inner tube preferably are of a length equal to or greater than the outer diameter of the inner tube to provide sufficient length for flexing to allow the relatively rigid filter elements to align tangentially to a curved section of a borehole.

The gravel pack elements 12 may be fixedly secured to the inner tube 14 as by welding of the end flanges or caps 36 and 38 to the inner tube. In such case the inner screen may be omitted by relying on the inner tube to contain the filtering media 42 as may be necessary if a loose aggregate filtering media is employed. The spacers 16 and stop collars 18 and 20 may also be omitted if the end caps are welded to the inner tube. The inner tube is perforated as by round holes or slits 48 in the regions circumscribed by the gravel pack elements to allow for passage of oil, gas or water through the gravel pack element and into the interior of the inner tube for flow through the production string to the surface.

Although the gravel pack elements 12 may be relatively permanently secured by welding to the inner tube 14 as above mentioned, preferably the gravel pack elements are strung onto the inner tube along with the spacers 16 which serve to maintain the spacing between adjacent gravel pack elements. As previously indicated, the string of alternating gravel pack elements 12 and spacers 16 is held together and in place on the inner tube by and between the stop collars 18 and 20.

The spacers 16 preferably closely surround the inner tube 14 to enable use of an inner tube which is substantially continuously perforated over an extent thereof normally spanning multiple gravel pack elements 12 and more preferably substantially from end-to-end. If the inner tube has perforations 48 substantially throughout its entire length or over a substantial portion thereof, the spacers additionally function to close the perforations in the segments of the inner tube located between the gravel pack elements.

As will be appreciated, the gravel pack elements 12 may be pre-made and stored until needed. When a gravel prepack is needed, the gravel pack elements may be assembled along with the spacers onto a perforated inner tube of selected length. In this manner, the gravel prepack may be configured on site to the particular application. For example, the spacing between gravel pack elements may be varied by using one or more spacers between adjacent elements or by cutting the spacers. Also, different lengths of gravel pack elements may be provided and assembled onto the inner tube to obtain a desired configuration, although gravel pack elements of the same length would normally be sufficient and advantageous by minimizing the number of different gravel pack elements that need to be stored. The gravel pack elements may also vary in outside diameter for use with production casings of different diameters. The gravel pack elements may also be butted end-to-end as may be desired in long radius wells to provide for increased production capacity per length of pipe. On the other hand, shorter gravel pack elements with greater spacing therebetween may be desired for use with short and ultra-short radius dog-legs. As will be appreciated, the use of interchangeable parts including the sleeves and gravel pack elements greatly facilitates the servicing and customizing of a gravel prepack to a particular application. The present invention provides for superior application flexibility.

The spacers 16 in the illustrated embodiment are metal sleeves. However, other types of spacers may be used such as rubber sleeves or boots. Of course, the material of the spacer, as well as the materials of the other components employed in the gravel prepack 10, should be capable of withstanding environmental conditions encountered downhole.

Figure 4:
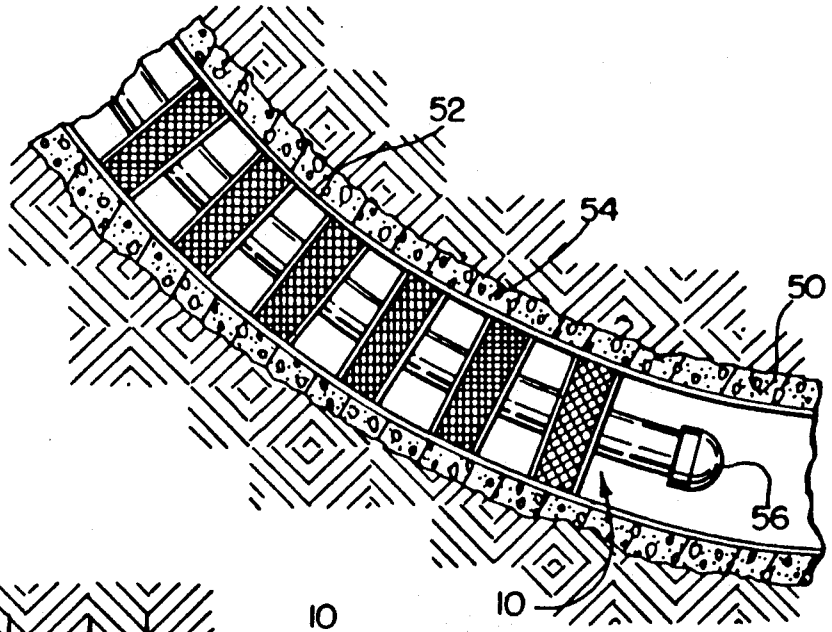
FIG. 4 is a schematic illustration of the gravel prepack traversing a dog-leg in an inclined well bore.

The assembled gravel prepack 10 may be connected to the end of a tubing string and fed in conventional manner into a bore hole which may include a dog-leg. FIG. 4 schematically shows a gravel prepack 10 traversing a dog-leg in an inclined well bore 50. The well bore contains a well casing 52 which extends through the well and is held in place by cement 54. As shown, the inner tube 14 flexes intermediate the gravel pack elements 12 to allow the gravel pack elements to rotate with respect to one another for passage through the dog-leg. The leading end of the gravel prepack is closed by a bull plug 56.

Figure 5:
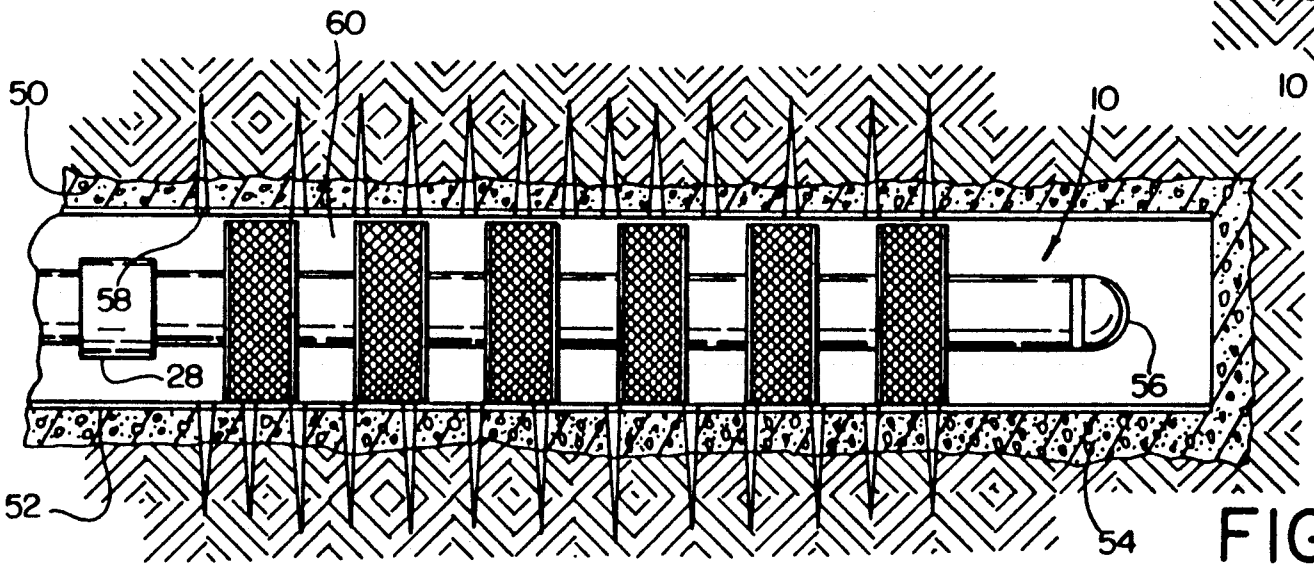
FIG. 5 is a schematic illustration of the gravel prepack installed in a subterranean producing formation.

In FIG. 5 the gravel prepack is shown installed in the subterranean producing formation. The well casing 52 is provided with perforations 58 in the producing zone. If desired, the annular space 60 between the gravel prepack and the casing 52 may be packed with gravel using conventional gravel packing techniques. However, the gravel prepack normally eliminates the need to rely on pumping and placing sand in a horizontal or high angle application such as is done in conventional gravel packs.

Gravel pack devices according to the invention will have particular application in wells with sand control problems coupled with high dog-leg severity and/or high angle or horizontal completions.

What is claimed is:

1. A gravel prepack to be installed in a hole formed in a fluid bearing formation to prevent sanding during production, comprising an inner tube, a plurality of discrete annular filter elements containing filter media, and spacer means for axially separating said filter elements along said inner tube, said filter elements being slidably carried on said inner tube and axially spaced apart along said inner tube by said spacer means to facilitate flexing of said inner tube for traversing a dog-leg in a hole formed in a fluid bearing formation, and said inner tube having openings therein for flow of fluid from said filter elements into the interior of said inner tube.

2. A gravel prepack as set forth in claim 1, wherein each annular filter element includes axially spaced apart end caps at opposite axial ends of an interior chamber containing said filter media, and a radially outer screen extending between said end caps and surrounding said filter media in said interior chamber.

3. A gravel prepack as set forth in claim 1, comprising spacers interposed between said annular filter elements and surrounding said inner tube.

4. A gravel prepack as set forth in claim 3, wherein said annular filter elements and spacers are strung onto said inner tube, and comprising means for securing the string of annular filter elements and spacers against axial movement along said inner tube.

5. A gravel prepack as set forth in claim 4, wherein said means for securing includes stop collars mounted to said inner tube at opposite axial ends of said string of annular filter elements and spacers.

6. A gravel prepack as set forth in claim 5, wherein at least one of said stop collars is screwed onto said inner tube.

7. A gravel prepack as set forth in claim 1, wherein said discrete annular filter elements are longitudinally spaced apart along said inner tube.

8. A gravel prepack to be installed in a hole formed in a fluid bearing formation to prevent sanding during production, comprising an inner tube, and a plurality of discrete annular filter elements carried on said inner tube and being relatively movable during flexing of said inner tube, said inner tube having openings therein for flow of fluid from said filter elements into the interior of said inner tube, each annular filter element including axially spaced apart end caps at opposite axial ends of an interior chamber containing filter media, and a radially outer screen extending between said end caps and surrounding said filter media in said interior chamber, and said annular filter element including a radially inner screen surrounded by said filter media in said interior chamber.

9. A gravel prepack as set forth in claim 8, wherein said inner and outer screens are concentric with said inner tube.

10. A gravel prepack to be installed in a hole formed in a fluid bearing formation to prevent sanding during production, comprising an inner tube, and a plurality of discrete annular filter elements carried on said inner tube and being relatively movable during flexing of said inner tube, said inner tube having openings therein for flow of fluid from said filter elements into the interior of said inner tube, said discrete annular filter elements being longitudinally spaced apart along said inner tube, and said inner tube being perforated with openings in regions between said spaced apart filter elements, and comprising closure means surrounding said regions to close the openings in said regions between said spaced apart filter elements.

11. A gravel prepack as set forth in claim 10, wherein said closure means includes sleeves closely surrounding said regions between said spaced apart filter elements.

12. A gravel prepack as set forth in claim 11, wherein said sleeves further operate to maintain said filter elements longitudinally spaced apart.

13. Gravel prepack equipment for assembly into a gravel prepack to be installed in a hole formed in a fluid bearing formation to prevent sanding during production, comprising a perforated inner tube, a plurality of annular filter elements adapted to be slid onto said inner tube, a plurality of spacers adapted to be slid onto said inner tube for spacing said filter elements longitudinally along said inner tube, and a pair of stop means for engaging respective ends of a string of said filter elements and spacers slidably carried on said inner tube to hold said filter elements and spacers in end-to-end butted relationship and to secure the string against axial movement along said inner tube while permitting limited sliding movement of said filter elements on said inner tube during flexing of said inner tube, at least one of said pair of stop means including a stop collar adapted to be screwed onto an end of said inner tube after the string of said filter elements and spacers have been slid onto said inner tube.

14. Gravel prepack equipment as set forth in claim 13, wherein each filter element includes end caps at opposite axial ends of an interior chamber containing filter media, each end cap having a center hole closely corresponding to the outer diameter of said inner tube.

15. A method of assembling a gravel prepack to be installed in a hole formed in a fluid bearing formation to prevent sanding during production, comprising the steps of stringing a plurality of annular filter elements onto an inner tube alternately with spacers operative to space the filter elements longitudinally along the inner tube, and then sandwiching the string of filter elements and spacers between stops secured to the inner tube at opposite ends of the string of filter elements and spacers such that the filter elements and spacers are held together in end-to-end butted relationship and the string thereof is secured against longitudinal movement along the inner tube while permitting limited sliding movement of said filter elements on said inner tube during flexing of said inner tube.

16. A method as set forth in claim 15, wherein at least one of the stops is secured to the inner tube by screwing the stop onto a threaded portion of the inner tube.

17. A gravel prepack to be installed in a hole formed in a fluid bearing formation to prevent sanding during production, comprising an inner tube, and a plurality of discrete annular filter elements carried on said tube and being relatively movable during flexing of said inner tube, said inner tube having openings therein for flow of fluid from said filter elements into the interior of said inner tube, each annular filter element including axially spaced apart end caps at opposite axial ends of an interior chamber containing filter media, and a radially outer screen extending between said end caps and surrounding said filter media in said interior chamber, said end caps of relatively adjacent filter elements being axially spaced apart and forming therebetween a radially outwardly open, annular space, whereby said filter elements can freely shift angularly with respect to one another during flexing of the inner tube when traversing a dog-leg in a hole formed in a fluid bearing formation.

18. A gravel prepack as set forth in claim 17, wherein said annular space formed between the end caps of relatively adjacent filter elements has an axial length no less than the outer diameter of said inner tube, thereby to provide sufficient length for flexing to allow the filter elements to align tangentially to a curved section of the hole in the fluid bearing formation.

19. A gravel prepack as set forth in claim 17, wherein each filter element has a length less than four times the inner diameter of said inner tube and wherein the ratio of the outer diameter of each filter element to the inner diameter of the inner tube is no less than 2.25:1.

* * * * *